US009376842B2

(12) United States Patent
Wittelsbuerger et al.

(10) Patent No.: US 9,376,842 B2
(45) Date of Patent: Jun. 28, 2016

(54) MOTOR VEHICLE LOCK

(71) Applicant: Brose Schliesssysteme GmbH & Co. KG, Wuppertal (DE)

(72) Inventors: Michael Wittelsbuerger, Lake Orion, MI (US); David Rosales, Rochester Hills, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 215 days.

(21) Appl. No.: 13/929,265

(22) Filed: Jun. 27, 2013

(65) Prior Publication Data

US 2014/0284945 A1 Sep. 25, 2014

Related U.S. Application Data

(60) Provisional application No. 61/804,923, filed on Mar. 25, 2013.

(51) Int. Cl.

| | |
|---|---|
| ***E05C 3/06*** | (2006.01) |
| ***E05B 77/06*** | (2014.01) |
| ***E05B 77/12*** | (2014.01) |

(Continued)

(52) U.S. Cl.

CPC ..... *E05B 77/06* (2013.01); *E05B 77/02* (2013.01); *E05B 77/04* (2013.01); *E05B 77/12* (2013.01); *E05B 2015/041* (2013.01); *E05B 2015/0496* (2013.01); *Y10T 292/0932* (2015.04)

(58) Field of Classification Search

CPC ..... E05B 77/02; E05B 77/04; E05B 77/06; E05B 77/12; Y10S 292/22

USPC ..... 292/201, 216

See application file for complete search history.

(56) References Cited

U.S. PATENT DOCUMENTS 4,441,345 A * 4/1984 Guarr ..... 70/240
5,967,572 A * 10/1999 Sajfert et al. ..... 292/336.3

(Continued)

FOREIGN PATENT DOCUMENTS

DE 202009009060 1/2011
DE 202009009061 1/2011

OTHER PUBLICATIONS

German Search Report for DE 10 2014 104 111.9, mailed Dec. 1, 2014 (7 pages).

(Continued)

*Primary Examiner* — Carlos Lugo
(74) *Attorney, Agent, or Firm* — Pauly, Devries Smith & Deffner, LLC

(57) ABSTRACT

The invention is directed to a lock for a door arrangement, wherein a catch and a pawl are provided. The catch can be in an open or closed position. The catch may be brought into holding engagement. The pawl may be brought into an engagement position. The pawl may be deflected into a release position. A pawl actuation lever is provided for deflecting the pawl. A switchable coupling arrangement comprises a first coupling lever, a second coupling lever and a spring biased coupling element. A control spring arrangement is provided that is engageable with the coupling element, which control spring arrangement acts against the spring bias of the coupling element, and that the pawl actuation lever is coupled to the control spring arrangement such that a predefined movement of the pawl actuation lever changes or eliminates the resulting force acting from the control spring arrangement onto the coupling element.

20 Claims, 5 Drawing Sheets

(51) Int. Cl.

| | |
|---|---|
| ***E05B 77/02*** | (2014.01) |
| ***E05B 77/04*** | (2014.01) |
| *E05C 3/16* | (2006.01) |
| *E05B 15/04* | (2006.01) |

(56) References Cited

U.S. PATENT DOCUMENTS

| | | | | |
|---|---|---|---|---|
| 7,175,211 | B2 * | 2/2007 | Cetnar et al. | 292/216 |
| 8,727,398 | B2 * | 5/2014 | Brose et al. | 292/198 |
| 8,764,077 | B2 | 7/2014 | Takagi et al. | |
| 8,967,678 | B2 * | 3/2015 | Rosales et al. | 292/196 |
| 9,074,393 | B2 * | 7/2015 | Brose et al. | |
| 9,109,380 | B2 | 8/2015 | Mittelbach et al. | |
| 2006/0267351 | A1 * | 11/2006 | Spurr | 292/216 |
| 2009/0322105 | A1 * | 12/2009 | Lee et al. | 292/237 |
| 2011/0181052 | A1 | 7/2011 | Brose et al. | |
| 2011/0252844 | A1 * | 10/2011 | Shoemaker | 70/100 |
| 2013/0147209 | A1 | 6/2013 | Lee et al. | |
| 2013/0147211 | A1 | 6/2013 | Lee et al. | |
| 2013/0313036 | A1 | 11/2013 | Kovie | |
| 2013/0328325 | A1 | 12/2013 | Uehara et al. | |
| 2014/0097624 | A1 | 4/2014 | Papanikolaou et al. | |
| 2014/0284942 | A1 | 9/2014 | Wittelsbuerger et al. | |
| 2014/0284943 | A1 | 9/2014 | Wittelsbuerger et al. | |
| 2014/0284944 | A1 | 9/2014 | Rosales et al. | |
| 2014/0346786 | A1 | 11/2014 | Takagi et al. | |

OTHER PUBLICATIONS

Non-Final Office Action for U.S. Appl. No. 13/929,258, mailed Mar. 27, 2015 (17 pages).

Non-Final Office Action for U.S. Appl. No. 13/929,278, mailed Mar. 31, 2015 (22 pages).

Search Report for German Patent Application No. 102014104188.6 related to U.S. Appl. No. 13/929,258, mailed Dec. 9, 2014 (7 pages).

Notice of Allowance for U.S. Appl. No. 13/929,278 mailed Nov. 2, 2015 (11 pages).

Notice of Allowance for U.S. Appl. No. 13/929,278 mailed Mar. 10, 2016 (11 pages).

* cited by examiner

MOTOR VEHICLE LOCK

CLAIM OF PRIORITY

This application claims the benefit of priority, under 35 U.S.C. Section 119(e), to U.S. Provisional Application No. 61/804,923, filed on Mar. 25, 2013, which is hereby incorporated by reference herein in its entirety.

FIELD OF THE INVENTION

The invention is directed to a motor vehicle lock for a motor vehicle door arrangement.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

The crash safety plays an important role for today's motor vehicle locks. It is of particular importance that neither crash induced acceleration nor crash induced deformation leads to an unintended opening of the motor vehicle door which the motor vehicle lock is assigned to. The focus of the present application is to prevent an unintended opening of the motor vehicle door based on crash induced acceleration. In case of a side impact on the motor vehicle the outer door handle may be reluctant to follow the impact due to mass inertia of the outer door handle. As a result a relative movement between the outer door handle and the motor vehicle door occurs, which again may lead to an unintended opening of the motor vehicle door.

The known motor vehicle lock (US 2011/0181052 A1), which is the starting point for the invention, is provided with the usual locking elements catch and pawl, wherein the pawl may be deflected into a release position by actuation of a pawl actuation lever.

The known motor vehicle lock also comprises a lock mechanism which may be brought into different functional states such as "unlocked" and "locked" by the user. The pawl may be deflected into its released position by an outer door handle which is connected to the pawl actuation lever, if the lock mechanism is in its unlocked state. With the lock mechanism being in its locked state an actuation of the pawl actuation lever runs free.

To guarantee a high crash safety the known motor vehicle lock comprises a crash element which is a separate component from the pawl actuation lever. By the accelerations which occur during a crash the crash element moves into a blocking position in which the crash element blocks further actuation of the pawl actuation lever.

One disadvantage of the known motor vehicle lock is the fact that before the intended blocking of the pawl actuation lever takes place the crash element has to perform the above noted movement into the blocking position. The necessity of the movement of the crash element before the intended blocking takes place leads to undesirable reaction times of the crash safety function.

Furthermore, for the known motor vehicle lock, the constructional design of the drive train between the door handle and the pawl appears to be challenging. This is true as in a crash situation the whole drive train starting from the door handle is being blocked. In order not to run the risk of an unpredictable blockage of the drive train, this drive train has to be designed for exceptionally high forces, which leads to high material and production costs.

SUMMARY

It is the object of the invention to improve the known motor vehicle lock such that a cost effective constructional design is possible without reducing the resulting crash safety.

The above noted object is solved for a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein a pawl actuation lever is provided for deflecting the pawl into the release position, wherein a switchable coupling arrangement is provided between the pawl actuation lever and the pawl, wherein the switchable coupling arrangement comprises a first coupling lever on the side of the pawl actuation lever, a second coupling lever on the side of the pawl and a moveable, spring biased coupling element that may be moved into a closing position for a coupling engagement with the two coupling levers and into an opening position for decoupling the two coupling levers, wherein a control spring arrangement is provided that is engaged or is engageable with the coupling element, which control spring arrangement with its spring bias acts against the spring bias of the coupling element, and that the pawl actuation lever is directly or indirectly coupled to the control spring arrangement such that a predefined movement of the pawl actuation lever changes or eliminates the resulting force acting from the control spring arrangement onto the coupling element.

First of all it is important that a predefined movement of the pawl actuation lever has a predefined effect on the coupling element of the switchable coupling arrangement. This effect comes into place only after a certain delay which goes back on mass inertia of the components of the switchable coupling arrangement, in particular, of the coupling element. The mass inertia based delay may be utilized to define the crash characteristics of the motor vehicle lock as will be explained later.

Second of all it is important that for realizing the above noted effect a control spring arrangement is provided that is engaged or is engageable with the coupling element. The control spring arrangement with its spring bias acts against the spring bias of the coupling element, wherein the pawl actuation lever is directly or indirectly coupled to the control spring arrangement such that a predefined movement of the pawl actuation lever changes or even eliminates the resulting force acting from the control spring arrangement onto the coupling element.

According to the invention it has been found that having a control spring arrangement directly act on the coupling element leads to a simplification in construction for an above noted, crash resistant motor vehicle lock.

An embodiment wherein the coupling element is designed as a resiliently elastically bendable wire or strip and can thereby be bent in a resiliently elastic manner into the closing position and into the opening position leads to a considerable simplification in construction of the switchable coupling arrangement. A resiliently elastically bendable wire or strip may easily be driven into different functional states and inherently guarantees its own spring bias, which preferably goes back mainly on its own elasticity.

In an embodiment the control spring arrangement is designed as a resiliently elastically bendable wire or strip as well. Also in this respect it has been found that a considerable simplification of construction may be achieved.

In an embodiment wherein with the pawl actuation lever in its non-actuated state the spring bias of the control spring arrangement holds the coupling element against its spring bias in its opening position, preferably, without being supported by the pawl actuation lever, the control spring arrangement guarantees the coupling element staying in its opening position as long as the pawl actuation lever is in its non-actuated state. According to an embodiment wherein deflecting the pawl actuation lever from its non-actuated state into its actuated state causes the control spring arrangement to act on the coupling element releasing the coupling element into the closing position, however, actuation of the pawl actuation lever releases the coupling element into the closing position. The coupling element is then following its spring bias and moving into the closing position.

If the pawl actuation lever is being actuated with a rapidity that is above a threshold rapidity, the pawl actuation lever runs free due to the mass inertia based delay in closing of the switchable coupling arrangement. The switchable coupling arrangement simply cannot follow the actuation of the pawl actuation lever quick enough, such that the pawl actuation lever runs free. This high rapidity actuation may be induced by the accelerations occurring in a crash situation. It becomes apparent that the crash safety measure is here not to move a crash element into a crash position. The crash element, here and preferably the coupling element, is already in the crash position, namely in the open position, at the time the crash occurs.

The further preferred embodiment wherein the engagement section of the control spring arrangement is designed as a bow like section and that during deflection of the pawl actuation lever from its non-actuated state into its actuated state the counter engagement section of the pawl actuation lever slides along the bow like engagement section of the control spring arrangement deflecting the control spring arrangement against its spring bias, shows an example how the design of the control spring arrangement simplifies the overall construction of the motor vehicle lock. The engagement section of the control spring arrangement, which is assigned to the counter engagement section of the pawl actuation lever, is simply made of a bow like section of the bendable wire or strip. This simple constructional measure guarantees a robust engagement between the pawl actuation lever and the control spring arrangement which in addition allows a high flexibility in construction.

In an embodiment, the invention provides for a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein a pawl actuation lever is provided for deflecting the pawl into the release position, wherein a switchable coupling arrangement is provided between the pawl actuation lever and the pawl, wherein the switchable coupling arrangement comprises a first coupling lever on the side of the pawl actuation lever, a second coupling lever on the side of the pawl and a moveable, spring biased coupling element that may be moved into a closing position for a coupling engagement with the two coupling levers and into an opening position for decoupling the two coupling levers, wherein a control spring arrangement is provided that is engaged or is engageable with the coupling element, which control spring arrangement with its spring bias acts against the spring bias of the coupling element, and that the pawl actuation lever is directly or indirectly coupled to the control spring arrangement such that a predefined movement of the pawl actuation lever changes or eliminates the resulting force acting from the control spring arrangement onto the coupling element.

In one embodiment, the coupling element is designed as a resiliently elastically bendable wire or strip and can thereby be bent in a resiliently elastic manner into the closing position and into the opening position.

In one embodiment, the spring bias of the coupling element goes back mainly on its own elasticity.

In one embodiment, the control spring arrangement is designed as a resiliently elastically bendable wire or strip.

In one embodiment, the coupling element is spring biased into the closing position.

In one embodiment, with the pawl actuation lever in its non-actuated state the spring bias of the control spring arrangement holds the coupling element against its spring bias in its opening position, preferably, without being supported by the pawl actuation lever.

In one embodiment, deflecting the pawl actuation lever from its non-actuated state into its actuated state causes the control spring arrangement to act on the coupling element releasing the coupling element into the closing position.

In one embodiment, releasing the pawl actuation lever from its actuated state into its non-actuated state causes the control spring arrangement to act on the coupling element deflecting the coupling element against its spring bias to the opening position.

In one embodiment, during deflection of the pawl actuation lever from its non-actuated state into its actuated state the pawl actuation lever deflects the control spring arrangement against its spring bias.

In one embodiment, during release of the pawl actuation lever (5) from its actuated state into its non-actuated state the pawl actuation lever releases the control spring arrangement following its spring bias.

In one embodiment, the control spring arrangement is mounted separately from the pawl actuation lever.

In one embodiment, the actuation of the pawl actuation lever comprises a release section of movement of the pawl actuation lever, during which the coupling element is being released to move into its closing position, and a subsequent pawl deflecting section of movement of the pawl actuation lever, during which the pawl is being deflected into its released position if the coupling element has reached its closing position during the release section of movement.

In one embodiment, deflecting the pawl actuation lever from its non-actuated state into its actuated state with a rapidity that is above a threshold rapidity, in particular induced by a crash, the pawl actuation lever runs free due to the mass inertia based delay in closing of the switchable coupling arrangement.

In one embodiment, the mass inertia based delay in closing of the switchable coupling arrangement during actuation of the pawl actuation lever goes back mainly on the weight distribution of the coupling element.

In one embodiment, the coupling element carries a weight arrangement in order to define the mass inertia based delay in closing of the switchable coupling arrangement.

In one embodiment, the control spring arrangement comprises an engagement section and that the pawl actuation lever comprises a counter engagement section and that the control spring arrangement with its engagement section is engaged or engageable with the counter engagement section of the pawl actuation lever.

In one embodiment, the engagement section of the control spring arrangement is designed as a bow like section and that during deflection of the pawl actuation lever from its non-actuated state into its actuated state the counter engagement section of the pawl actuation lever slides along the bow like engagement section of the control spring arrangement deflecting the control spring arrangement against its spring bias.

In one embodiment, a lock mechanism is provided, which may be brought into different functional states such as "unlocked" and "locked" via a lock actuation arrangement and that the lock mechanism acts on the switchable coupling arrangement for realizing the functional states "unlocked" and "locked" such that in the functional state "unlocked" the switchable coupling arrangement closes and in the functional state "locked" opens.

In one embodiment, with the pawl actuation lever in its non-actuated state the spring bias of the control spring arrangement holds the coupling element against its spring bias in its opening position without being supported by the pawl actuation lever.

BRIEF DESCRIPTION OF THE FIGURES

In the following the invention will be described in an example referring to the drawings. In the drawings show FIG. 1 the relevant parts of a proposed motor vehicle lock in a perspective view basically on the front side, FIG. 2 the motor vehicle lock according to FIG. 1 in a perspective view on the back side with the switchable coupling arrangement a) in the closing state and b) in the opening state, FIG. 3 the motor vehicle lock according to FIG. 1 in a perspective view basically on the back side with the switchable coupling arrangement in the closing state a) in the half actuated state and b) in the fully actuated state, FIG. 4 the motor vehicle lock according to FIG. 1 in a perspective view basically on the back side during crash induced actuation of the pawl actuation lever and FIG. 5 selected components of the motor vehicle lock according to FIG. 1 to display the principle of the invention.

DETAILED DESCRIPTION

Figure 1:
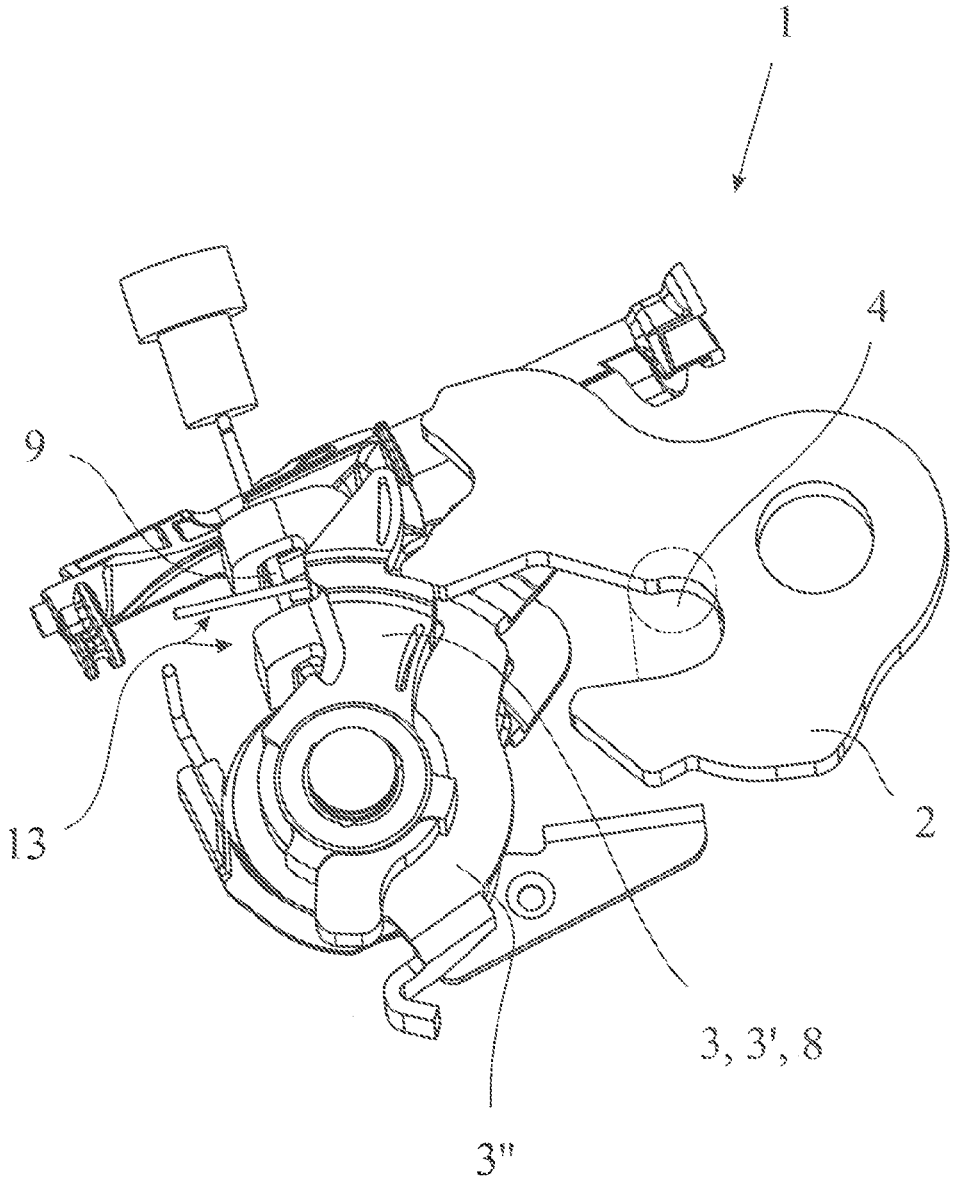

The motor vehicle lock 1 shown in the drawings is assigned to a motor vehicle door arrangement, which comprises a motor vehicle door (not shown) besides said motor vehicle lock 1. Regarding the broad interpretation of the expression "motor vehicle door" reference is made to the introductory part of the specification. Here and preferably the motor vehicle door is a side door of a motor vehicle.

The motor vehicle lock 1 comprises the usual locking elements catch 2 and pawl 3, which pawl 3 is assigned to the catch 2. The catch 2 can be brought into an open position (not shown) and into a closed position (FIG. 1). In the closed position shown in FIG. 1 the catch 2 is or may be brought into holding engagement with a lock striker 4 that is indicated in FIG. 1 as well. The motor vehicle lock 1 is normally arranged at or in the motor vehicle door, while the lock striker 4 is arranged at the motor vehicle body.

The pawl 3 may be brought into an engagement position shown in FIG. 1, in which it is in blocking engagement with the catch 2. Here and preferably the pawl 3 blocks the catch 2 in its closed position in a mechanically stable manner such that the pawl 3 itself does not have to be blocked. For release of the catch 2 into its open position the pawl 3 may be deflected into a release position (not shown), which would be a deflection in the anti-clockwise direction in FIG. 1.

A pawl actuation lever 5 is provided for deflecting the pawl 3 into the release position. The pawl actuation lever 5 may be coupled to a door handle, preferably to an outer door handle, such that the assigned motor vehicle door may be opened by actuating the door handle.

Further, a switchable coupling arrangement 6 is provided between the pawl actuation lever 5 and the pawl 3, wherein the switchable coupling arrangement 6 comprises a first coupling lever 7 on the side of the pawl actuation lever 5, a second coupling lever 8 on the side of the pawl 3 and a movable, spring biased coupling element 9 that may be moved into a closing position (FIG. 3) for a coupling engagement with the two coupling levers 7, 8 and into an opening position (FIG. 2, 4, 5) for decoupling the two coupling levers 7, 8. The coupling element 9 here and preferably is designed as a resiliently elastically bendable wire or strip with a spring bias acting downwards in the drawings which is indicated by reference number 9*a*.

It is essential for the present invention that a control spring arrangement 10 is provided that is engaged or at least engageable with the coupling element 9. The control spring arrangement 10 is designed as a resiliently elastically bendable wire or strip as well with a spring bias acting upwardly in the drawings which is indicated with the reference number 10*a*. All advantages and variants that have been explained with respect to the bendable design of the coupling element 9 are applicable to the bendable control spring arrangement 10 accordingly.

The control spring arrangement 10 with its spring bias 10*a* acts against the spring bias 9*a* of the coupling element 9 as noted above. Here and preferably the spring bias 10*a* of the control spring arrangement 10 is large enough to hold the coupling element 9 against its spring bias 9*a* in the open position, as may be seen best in FIG. 2*a*. FIG. 2*a* also shows that the control spring arrangement 10 is not being supported by the pawl actuation lever 5 at all, which again makes an easy mechanical construction.

The pawl actuation lever 5 is directly or indirectly coupled to the control spring arrangement 10 such that a predefined movement of the pawl actuation lever 5 changes the resulting force acting from the control spring arrangement 10 onto the coupling element 9. It may even be foreseen that a certain movement of the pawl actuation lever 5 eliminates the resulting force acting from the control spring arrangement 10 onto the coupling element 9. In other words, a movement of the pawl actuation lever 5 may alter the influence of the control spring arrangement 10 onto the coupling element 9. Depending on the field of use this structural design can be particularly advantageous in view of the resulting crash safety. This is true especially if the control spring arrangement 10 holds the coupling element 9 in its open position as long as the pawl actuation lever 5 is in its non-actuated state, as will be explained later as well.

Generally, the coupling element 9 may be designed as a coupling lever or the like. Here and preferably, however, the coupling element 9 is designed as a resiliently elastically bendable wire or strip as noted above, which coupling element 9 can thereby be bent in a resiliently elastic manner into the closing position and into the opening position.

The bendable coupling element 9 is bendable substantially about a geometric bending axis which is aligned perpendicular to the longitudinal extent of at least a part of the bendable coupling element. With the proposed design of the coupling element 9 the movability of the coupling element 9 goes back on its bendability which makes the constructional design simple and thereby cost effective.

With regard to the material selection for the bendable coupling element 9, various preferred alternatives are conceivable. In one particularly preferred embodiment, the bendable coupling element 9 is composed of a metal material, preferably spring steel. It may however also be advantageous for the bendable coupling element 9 to be formed from a plastic material.

For the shaping of the bendable coupling element 9, too, various advantages alternatives are conceivable. The bendable coupling element 9 preferably has a circular cross section. From a production aspect in particular, it may however also be advantageous for the bendable coupling element 9 to be of strip-shaped design, since such elements can be fastened in a simple manner.

In the illustrated in thus preferable embodiment, the bendable coupling element 9 is of straight design in sections. Depending on the application, it may however also be advantageous for the bendable coupling element 9 to be adapted to the structural conditions and to defer considerably from a straight design.

In the illustrated and thus preferably embodiment, the bendable coupling element 9 is formed as a single piece of wire which has the same resiliently elastic properties over its entire length. It may however also be advantageous for the bendable coupling element 9 to be resiliently elastically flexible only in sections and to otherwise be of more rigid design. This may be achieved for example by means of a wire cross section which varies over the length of the wire.

Figure 2:
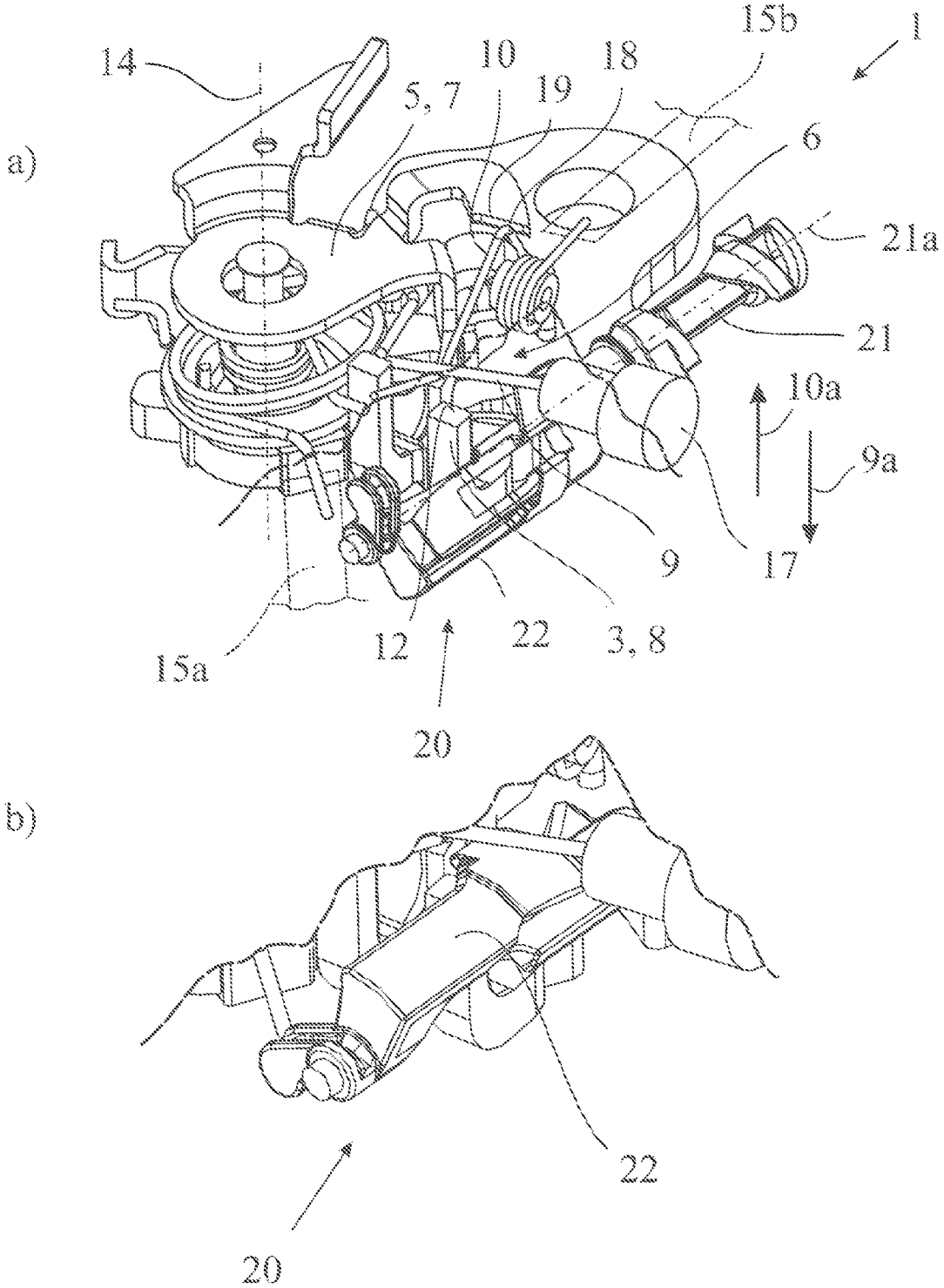
Figure 5:
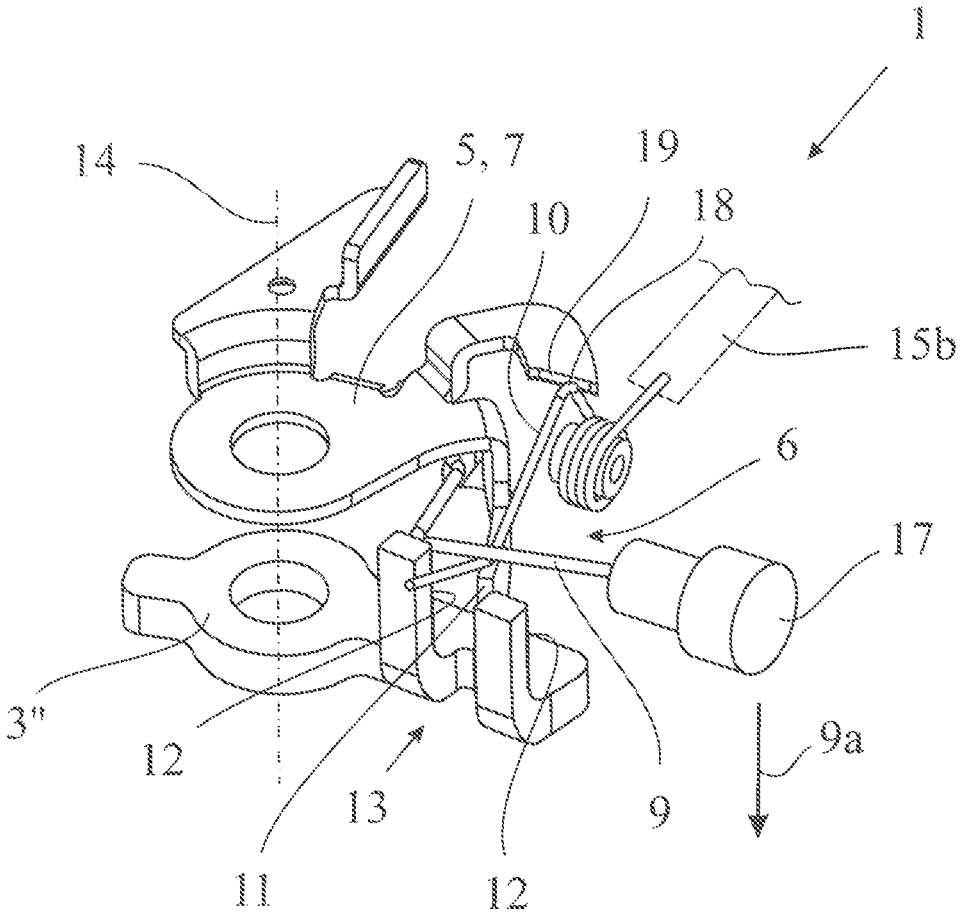

As noted above the coupling element 9 serves to couple or decouple the coupling levers 7, 8. Here and preferably the first coupling lever 7 is the pawl actuation lever 5 itself and the second coupling lever is the pawl 3 itself. For this the pawl actuation lever 5 comprises a coupling section 11 and the pawl 3 comprises a coupling section 12. FIGS. 1 and 2 in combination show that the coupling section 12 of the pawl 3 is part of a 90° bent section 13 of the pawl 3. For clarification it may be noted that the pawl 3 in the shown embodiment comprises two sections 3' and 3" that are connected. The bent section 13 is located at the section 3" as may best be seen in FIG. 5.

In the closing position (FIG. 3) of the coupling element 9 the coupling element 9 is or can be engaged with the coupling levers 7, 8 and couples the coupling levers 7, 8, while the coupling element 9 in the opening position (FIG. 2, 4, 5) is disengaged from at least one coupling lever 7, 8, here and preferably from at least the pawl actuation lever 5, and decouples the coupling levers 7, 8.

With the coupling element 9 in its opening position the coupling section 11 of the pawl actuation lever 5 can pass by the coupling element 9 without having an effect on the second coupling lever 8, namely the pawl 3. While in the closing position (FIG. 3) the coupling section 11 of the pawl actuation lever 5 comes into engagement with the coupling element 9, whereas the coupling element 9 comes into engagement with the coupling section 12 of the pawl 3, deflecting the pawl 3 into its release position. The above noted actuation of the pawl actuation lever 5 goes back on a movement of the pawl actuation lever 5 in clockwise direction in the drawings.

With the coupling element 9 being a resiliently elastically bendable wire or strip it is further preferred that the force which can be transmitted via the bendable coupling element 9 acts perpendicular to the extent of the coupling element 9. This may be taken from the representation in FIG. 3.

The design of the coupling element 9 as a resiliently elastically bendable wire or strip is particularly advantageous as the spring bias of the coupling element 9 may go back mainly on its own elasticity. An additional spring arrangement for realizing the spring bias of the coupling element 9 is therefore not necessary.

Figure 3:
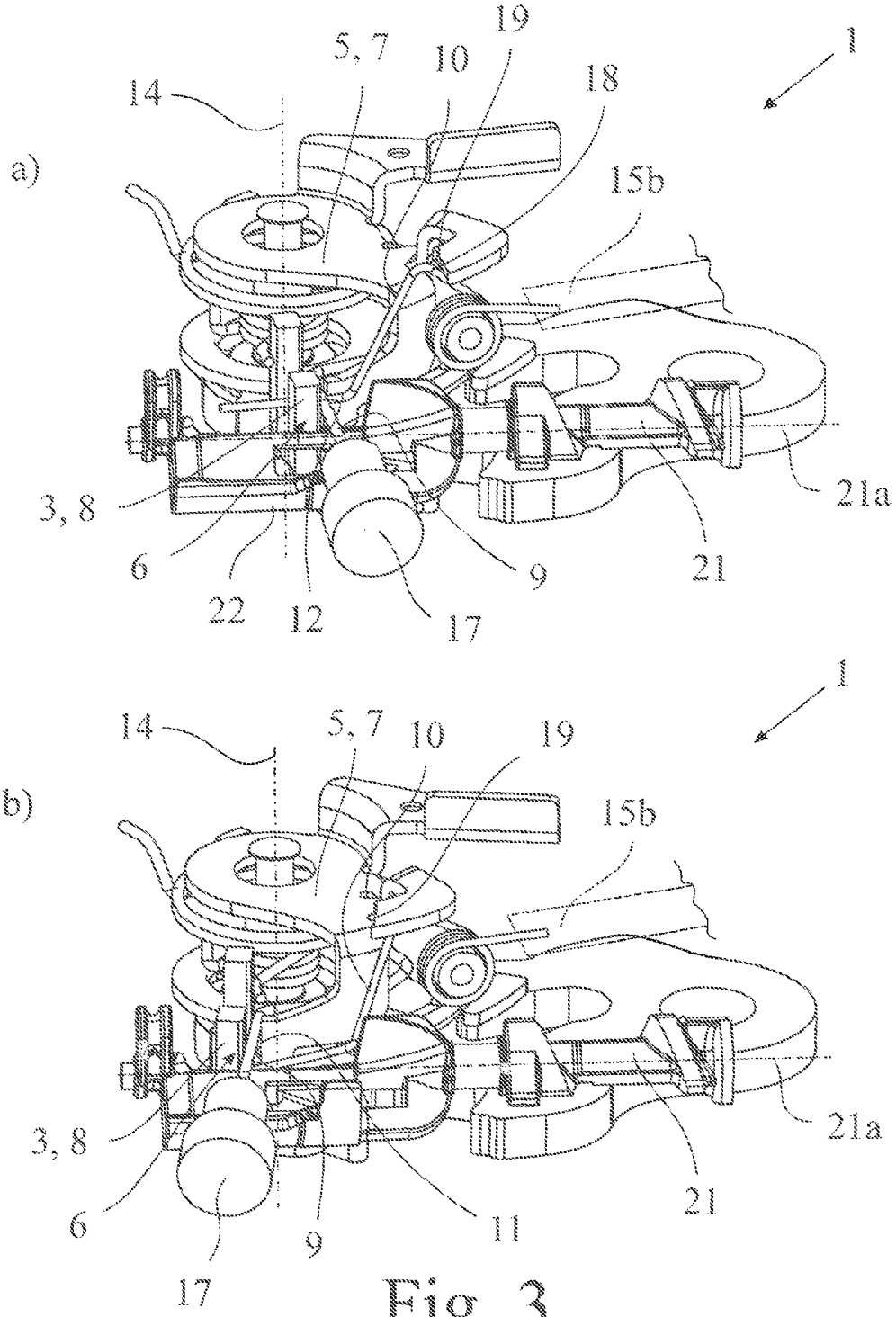

The bendable coupling element 9 at one of it ends is wound basically around an axis 14 which is also the geometrical axis of the pawl actuation lever 5. The end of the winding of the coupling element 9 is blocked by a blocking element 15*a*. The straight section 16 of the coupling element 9 can follow the movement of the pawl actuation lever 5 while deflecting the pawl 3 into its release position (FIG. 3).

In a similar manner, the bendable control spring arrangement 10 is wound around a geometrical axis which winding in this particular case defines the spring bias 10*a* of the control spring arrangement 10. The respective end of the control spring arrangement 10 is blocked against movement by another blocking element 15*b*. It is to be understood that the blocking elements 15*a*, 15*b* may be part of a housing of the motor vehicle lock 1.

In the illustrated embodiment the coupling element 9 is spring biased into the closing position, in the drawing downwards in the direction 9*a* as noted above.

Preferably, with the pawl actuation lever 5 in its non-actuated state (FIG. 2*a*), the spring bias 10*a* of the control spring arrangement 10 holds the coupling element 9 against its spring bias 9*a* in its opening position. This situation is normally the situation before any crash occurs.

Deflecting the pawl actuation lever 5 from its non-actuated state (FIG. 2*a*) into its actuated state (FIG. 3, 4) causes the control spring arrangement 10 to act on the coupling element 9 releasing the coupling element 9 into the closing position. As will be explained later the movement of the pawl actuation lever 5 here at least partly neutralizes the effect of the control spring arrangement 10 on the coupling element 9 such that the coupling element 9, driven by its spring bias 9*a*, may travel into the direction of the closing position. Releasing the pawl actuation lever 5 from its actuated state (FIG. 3, 4) into its non-actuated state (FIG. 2*a*) again causes the control spring arrangement 10 to act on the coupling element 9 deflecting the coupling element 9 against its spring bias 9*a* to the open position.

It is preferred that during deflection of the pawl actuation lever 5 from its non-actuated state into its actuated state the pawl actuation lever 5 deflects the control spring arrangement 10 against its spring bias 10*a* which may be seen in FIG. 3. Accordingly, the control spring arrangement 10 is being compressed. During release of the pawl actuation lever 5 from its actuated state into its non-actuated state the pawl actuation lever 5 releases the control spring arrangement 10 following its spring bias 10*a*. Accordingly, the control spring arrangement 10 is at least partly being relaxed. This relaxation preferably goes only to a restricted extend such that the spring bias is still large enough to hold the coupling element 9 in its opening position.

This means, as noted above, that the pawl actuation lever 5 in its non-actuated state does not even have to support the control spring arrangement 10 by holding the coupling element 9 in its opening position. It has been noted above as well, that this leads to a particularly simple mechanical construction.

The control spring arrangement 10 is mounted separately from the pawl actuation lever 5. This means in particular that the control spring arrangement 10 is not mounted on the pawl actuation lever 5. The control spring arrangement 10 may accordingly be mounted on a fixed component of the motor vehicle lock 1. Such a fixed component may be a housing component of the motor vehicle lock 1 or the like.

It is of particular importance for the crash safety that the actuation of the pawl actuation lever 5 comprises a release section of movement of the pawl actuation lever 5, during which the coupling element 9 is being released to move into its closing position. In the drawing, this is the movement of the pawl actuation lever 5 in clockwise direction from the position shown in FIG. 2 to a position in which the coupling section 11 of the pawl actuation lever 5 is about to come into contact with the coupling element 9 as is shown in FIG. 3*a*. Subsequently, a pawl deflecting section of movement follows the release section of movement. During the pawl deflecting section of movement of the pawl actuation lever 5 the pawl 3 is being deflected into its released position if the coupling element 9 has reached its closing position during the release section of movement. The pawl deflecting section of movement starts from the position shown in FIG. 3*a* and ends in the position shown in FIG. 3*b*.

FIGS. 3*a* and 3*b* in combination show the deflection of the pawl 3 into its release position by actuation of the pawl actuation lever 5 during normal operation.

Figure 4:
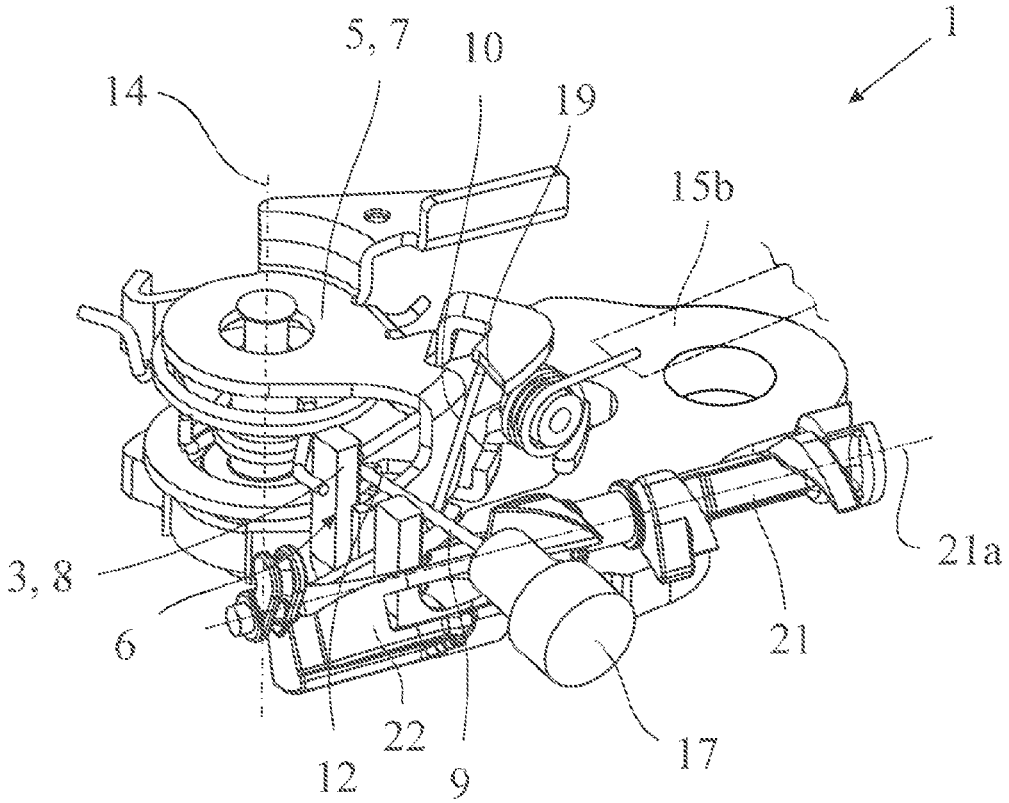

In the case the pawl actuation lever 5 is deflected from its non-actuated state into its actuated state with a rapidity that is above a threshold rapidity, which deflection may be induced by a crash, the pawl actuation lever 5 runs free without deflecting the pawl 3 into its release position due to mass inertia based delay in closing of the switchable coupling arrangement 6, in particular in moving the coupling element 9 into its closing position. In other words, after the control spring arrangement 10 has released the coupling element 9 into the closing position due to the movement of the pawl actuation lever 5 from its non-actuated state into the direction of its actuated state the coupling element 9, driven by its spring bias, has to reach the closing state during the above noted release section of movement of the pawl actuation lever 5. The delay in movement of the coupling element 9 goes back mainly on the weight distribution of the coupling element 9. If the pawl actuation lever 5 reaches the pawl deflecting section of movement before the coupling element 9 reaches the closing position, as a result, the pawl actuation lever 5 passes the coupling element 9 without deflecting the pawl 3 into its release position as shown in FIG. 4.

The above noted mass inertia based delay in moving the coupling element 9 into its closing position may easily be influenced by providing the coupling element 9 with a weight arrangement 17. With the coupling element 9 carrying said weight arrangement 17 the mass inertia based delay in closing of the switchable coupling arrangement 6 altogether may exactly be defined.

There are various ways for the coupling of the pawl actuation lever 5 with the control spring arrangement 10. Preferably the control spring arrangement 10 comprises an engagement section 18 while the pawl actuation lever 5 comprises a counter engagement section 19. The control spring arrangement 10 with its engagement section 18 is engaged or engageable with the counter engagement section 19 of the pawl actuation lever 5. In further detail, during deflection of the pawl actuation lever 5 from its non-actuated state (FIG. 2) into its actuated state (FIG. 3*a*, FIG. 3*b*) the pawl actuation lever 5 via its counter engagement section 19 and the engagement section 18 of the control spring arrangement 10 deflects the control spring arrangement 10 against its spring bias 10*a*.

The design of the control spring arrangement 10 as a resiliently elastically bendable wire or strip allows a particularly simple construction of the engagement section 18. In further detail the engagement section 18 of the control spring arrangement 10 is designed as a bow like section, wherein during deflection of the pawl actuation lever 5 from its non-actuated state (FIG. 2*a*) into its actuated state (FIG. 3*a*, FIG. 3*b*) the counter engagement section 19 of the pawl actuation lever 5 slides along the bow like engagement section 18 of the control spring arrangement 10 deflecting the control spring arrangement 10 against its spring bias 10*a*.

In the non-actuated state the pawl actuation lever 5 at least partly, here and preferably completely, releases the control spring arrangement 10 to follow its spring bias 10*a*.

As shown in FIG. 2*a*, in the engaged state, the control spring arrangement 10 and the coupling element 9 are extending basically perpendicular to each other. This ensures a safe and reproducible engagement.

In a further preferred embodiment a lock mechanism 20 is provided, which may be brought into different functional states such as "unlocked" and "locked" via a lock actuation arrangement indicated in the drawings. Those functional states are useful during normal operation, in particular when a door handle, which is connected to the pawl actuation lever 5, shall be enabled or disabled regarding deflecting of the pawl 3. The lock mechanism 20 with its lock actuation arrangement acts on the switchable coupling arrangement 6 for realizing the functional states "unlocked" and "locked" such that the switchable coupling arrangement 6 closes in the functional state "unlocked" and opens in the functional state "locked".

The lock actuation arrangement is here and preferably a control camshaft 21 which extends along a geometrical camshaft axis 21*a*. To realize the functional state "locked" the camshaft 21 is turned from the position shown in FIG. 2*a*) into the position shown in FIG. 2*b*. By this movement of the camshaft 21 the cam 22 is positioned that it blocks the movement of the coupling element 9 from the opening position into the closing position. Accordingly, during an actuation of the pawl actuation lever 5 the coupling element 9, which is being released by the control spring arrangement 10 moves into the direction of the closing position, driven by its spring bias 9*a*, which movement is being blocked by the cam 22 which is in the position shown in FIG. 2*b*. It is particularly advantageous that the camshaft 21 is completely free of the coupling element 9, as long as the pawl actuation lever 5 is in its non-actuated state (FIG. 2*a*). This means that any movement of the camshaft 21 is possible without being hindered by an interaction with the spring biased coupling element 9.

Finally it may be pointed out that the proposed solution is not only applicable to a motor vehicle lock 1 that is actuated manually by actuating a door handle. In the case that the pawl actuation lever 5 is drivable by a motor drive, a crash induced actuation of the pawl actuation lever 5 with high rapidity accordingly leads to the pawl actuation lever 5 running free as noted above.

The invention claimed is:

1. A motor vehicle lock for a motor vehicle door arrangement, comprising:

a catch, a pawl, which is assigned to the catch, a pawl actuation lever, a switchable coupling arrangement, and a control spring arrangement, wherein the catch can be brought into an open position and into a closed position, wherein the catch, when in the closed position, is or may be brought into holding engagement with a lock striker, wherein the pawl may be brought into an engagement position, in which it is in blocking engagement with the catch, wherein the pawl is deflectable into a release position, in which it releases the catch, wherein the pawl actuation lever is provided for deflecting the pawl into the release position, wherein the switchable coupling arrangement comprises the pawl actuation lever, the pawl and a moveable, spring biased coupling element that is configured to be moved into a closing position for a coupling engagement with the pawl actuation lever and the pawl and into an opening position for decoupling the pawl actuation lever from the pawl, wherein the control spring arrangement is engaged or is engageable with the switchable coupling element, wherein the control spring arrangement with its spring bias acts against the spring bias of the coupling element, and wherein the pawl actuation lever is directly or indirectly coupled to the control spring arrangement such that a predefined movement of the pawl actuation lever changes or eliminates the resulting force acting from the control spring arrangement onto the coupling element.

2. The motor vehicle lock according to claim 1, wherein the coupling element is designed as a resiliently elastically bendable wire or strip and can thereby be bent in a resiliently elastic manner into the closing position and into the opening position.

3. The motor vehicle lock according to claim 1, wherein the spring bias of the coupling element goes back mainly on its own elasticity.

4. The motor vehicle lock according to claim 1, wherein the control spring arrangement is designed as a resiliently elastically bendable wire or strip.

5. The motor vehicle lock according to claim 1, wherein the coupling element is spring biased into the closing position.

6. The motor vehicle lock according to claim 1, wherein with the pawl actuation lever in its non-actuated state the spring bias of the control spring arrangement holds the coupling element against its spring bias in its opening position, without being supported by the pawl actuation lever.

7. The motor vehicle lock according to claim 1, wherein deflecting the pawl actuation lever from its non-actuated state into its actuated state causes the control spring arrangement to act on the coupling element releasing the coupling element into the closing position.

8. The motor vehicle lock according to claim 1, wherein releasing the pawl actuation lever from its actuated state into its non-actuated state causes the control spring arrangement to act on the coupling element deflecting the coupling element against its spring bias to the opening position.

9. The motor vehicle lock according to claim 1, wherein during deflection of the pawl actuation lever from its non-actuated state into its actuated state the pawl actuation lever deflects the control spring arrangement against its spring bias.

10. The motor vehicle lock according to claim 1, wherein during release of the pawl actuation lever from its actuated state into its non-actuated state the pawl actuation lever releases the control spring arrangement following its spring bias.

11. The motor vehicle lock according to claim 1, wherein the control spring arrangement is mounted separately from the pawl actuation lever.

12. The motor vehicle lock according to claim 1, wherein the actuation of the pawl actuation lever comprises a release section of movement of the pawl actuation lever, during which the coupling element is being released to move into its closing position, and a subsequent pawl deflecting section of movement of the pawl actuation lever, during which the pawl is being deflected into its released position if the coupling element has reached its closing position during the release section of movement.

13. The motor vehicle lock according to claim 1, wherein deflecting the pawl actuation lever from its non-actuated state into its actuated state with a rapidity that is above a threshold rapidity and induced by a crash, the pawl actuation lever runs free due to the mass inertia based delay in closing of the switchable coupling arrangement.

14. The motor vehicle lock according to claim 10, wherein the mass inertia based delay in closing of the switchable coupling arrangement during actuation of the pawl actuation lever goes back mainly on the weight distribution of the coupling element.

15. The motor vehicle lock according to claim 1, wherein the coupling element carries a weight arrangement in order to define the mass inertia based delay in closing of the switchable coupling arrangement.

16. The motor vehicle lock according to claim 1, wherein the control spring arrangement comprises an engagement section and that the pawl actuation lever comprises a counter engagement section and that the control spring arrangement with its engagement section is engaged or engageable with the counter engagement section of the pawl actuation lever.

17. The motor vehicle lock according to claim 13, wherein the engagement section of the control spring arrangement is designed as a bow like section and that during deflection of the pawl actuation lever from its non-actuated state into its actuated state the counter engagement section of the pawl actuation lever slides along the bow like engagement section of the control spring arrangement deflecting the control spring arrangement against its spring bias.

18. The motor vehicle lock according to claim 1, wherein a lock mechanism is provided, which may be brought into different functional states such as "unlocked" and "locked" via a lock actuation arrangement and that the lock mechanism acts on the switchable coupling arrangement for realizing the functional states "unlocked" and "locked" such that in the functional state "unlocked" the switchable coupling arrangement closes and in the functional state "locked" opens.

19. The motor vehicle lock according to claim 1, wherein with the pawl actuation lever in its non-actuated state the spring bias of the control spring arrangement holds the coupling element against its spring bias in its opening position without being supported by the pawl actuation lever.

20. The motor vehicle lock according to claim 1, wherein the pawl comprises a first section connected to a second section.

* * * * *